United States Patent [19]

Haeszner et al.

[11] Patent Number: 4,718,177

[45] Date of Patent: Jan. 12, 1988

[54] DEVICE FOR CONDENSATE REMOVAL FROM A STEAM-HEATED DRYING CYLINDER

[75] Inventors: Winfried Haeszner; Werner Junginger; Karl Jenkner, all of Heidenheim; Robert Wolf, Herbrechtingen; Christian Schiel, Heidenheim, all of Fed. Rep. of Germany

[73] Assignee: J. M. Voith, GmbH, Heidenheim, Fed. Rep. of Germany

[21] Appl. No.: 789,400

[22] Filed: Oct. 21, 1985

[30] Foreign Application Priority Data

Oct. 25, 1984 [DE] Fed. Rep. of Germany ..... 3439105

[51] Int. Cl.[4] ..... A26B 23/10

[52] U.S. Cl. ..... 34/119; 34/124; 34/125

[58] Field of Search ..... 34/119, 124, 125; 165/90

[56] References Cited

U.S. PATENT DOCUMENTS

| | | | |
|---|---|---|---|
| 2,892,264 | 6/1959 | Armstrong | 34/125 |
| 2,993,282 | 7/1961 | Daane et al. | 34/125 |
| 3,034,225 | 5/1962 | Hieronymus | 34/125 |
| 3,264,754 | 8/1966 | Kutchera | 34/124 |
| 3,328,896 | 7/1967 | Hanf | 34/125 |
| 4,369,586 | 1/1983 | Wedel | 34/125 |
| 4,384,412 | 5/1983 | Chance et al. | 34/125 |
| 4,498,249 | 2/1985 | Cooke et al. | 34/125 |
| 4,516,334 | 5/1985 | Wanke | 34/125 |

FOREIGN PATENT DOCUMENTS

| | | |
|---|---|---|
| 2413271 | 10/1974 | Fed. Rep. of Germany . |
| 3414,605 | 10/1985 | Fed. Rep. of Germany . |

*Primary Examiner*—Albert J. Makay
*Assistant Examiner*—David W. Westphal
*Attorney, Agent, or Firm*—Jeffers, Hoffman & Niewyk

[57] ABSTRACT

A device for condensate removal from a steam-heated rotatable drying cylinder having a condensate suction pipe rotating with the drying cylinder and featuring a suction mouthpiece on the inside surface of the cylinder shell. A steam blowing line extends from the area of the axis of rotation of the drying cylinder into the interior of the suction mouthpiece. The mouth of the steam blowing line located there is arranged a maximally short distance from the inside surface of the cylinder shell and is directed and/or aligned on the condensate suction pipe.

12 Claims, 4 Drawing Figures

DEVICE FOR CONDENSATE REMOVAL FROM A STEAM-HEATED DRYING CYLINDER

BACKGROUND OF THE INVENTION

The invention concerns a device for removal of condensate from a steam-heated, rotatable drying cylinder, and more specifically, a steam-heated, rotatable drying cylinder of the type used on paper machines for drying a freshly produced web.

Among those familiar with the art such a device for condensate removal is generally termed a "rotating syphon." This design has the advantage that no relative movement takes place between the rotating drying cylinder and the siphon because the siphon is rigidly mounted in the drying cylinder so that both rotate jointly. In another prior design, the siphon is fixed so that it does not participate in the rotary movement of the drying cylinder.

Rotating siphons employ various designs for the suction mouthpiece. For instance, it may have a shape approximating a plate such as in U.S. Pat. No. 3,034,225, or it may have a shape approximating a bell such as in U.S. Pat. No. 2,993,282. Additionally, the suction mouthpiece, which may also be designed as a box, may be provided with a funnel-type suction snout opening in the direction of rotation such as in U.S. Pat. No. 2,892,264. Such a snout facilitates the condensate removal from the drying cylinder especially when the drying cylinder is rotating at a relatively low speed permitting the condensate to form a sump, while otherwise when the drying cylinder is rotating at higher operating speeds the condensate lies as a ring-shaped film on the inside surface of the cylinder shell.

Previously known from the German Patent Publication No. 14 61 125 (which is the counterpart to U.S. Pat. No. 3,264,754) is a suction mouthpiece having the shape of a flat nozzle. The slot-shaped inlet opening extends parallel with the direction of rotation. The condensate influx can be promoted by inclined surfaces having an inclination which is axially parallel with the inside surface of the shell.

The condensate removal is in all cases effected by adjusting inside the drying cylinder a pressure higher than in the condensate suction pipe including the suction mouthpiece. Thus, part of the supplied steam flows constantly through the rotating siphon mixing with a certain amount of the condensate and moving it outside.

To enhance the conveying effect on the condensate, a side channel for feeding additional steam may be provided at the transition from the suction mouthpiece into the condensate suction pipe. Previously known from U.S. Pat. No. 2,993,282 or German Patent Publication 14 61 125, this side channel is presented by simply providing a bore extending through the wall of the suction mouthpiece.

In U.S. Pat. No. 2,993,282 it is known to arrange in the bell-shaped suction mouthpiece an insert which has the shape of a partitioning wall which extends parallel with the axis of rotation of the cylinder. This partitioning wall guides the condensate into the interior of the suction mouthpiece. According to U.S. Pat. No. 4,384,412, the partitioning wall may be given the shape of a wedge, as viewed in cross section, to improve the deflection effect.

Many of these prior designs have proved themselves in practice when the drying cylinder is being operated at various operating speeds wherein the condensate sometimes forms a ring and sometimes a sump. But under certain unusual conditions, especially when the normal operation is somehow interrupted, these earlier devices have failed to remove the condensate. Under these conditions the drying cylinder is said to be "flooded" i.e., it fills up increasingly with condensate. In extreme cases, the drying cylinder is filled with condensate almost up to the axis of rotation.

SUMMARY OF THE INVENTION

The problem to which the invention is directed is to improve the initially described device for condensate removal so that in the event of any operational interferences the flooding of the drying cylinder will be avoided with greater safety than has existed heretofore.

It has been recognized that in the event of imminent flooding it must be guaranteed that the steam entering the interior of the suction mouthpiece through the side channel must discharge from the mouth of the side channel at an optimally short distance from the inside surface of the cylinder shell. The reasoning is that at the outset of flooding steam can no longer enter the interior of the suction mouthpiece through the inlet gap between the suction mouthpiece and the inside of the cylinder shell. Therefore, the steam entering through the side channel must in these cases solely bring about the condensate removal. Obviously, it is then insufficient if the side channel, according to prior designs, is just a simple bore in the wall of the suction mouthpiece. Therefore, the side channel is inventionally designed as a steam blowing line which originates from the inside of the drying cylinder and proceeds into the suction mouthpiece and has its discharge opening arranged there at an only slight distance from the cylinder inside wall so that the discharging jet of steam dependably entrains the condensate already at a slight increase of the condensate level and moves it into the condensate suction pipe. In the normal, uninterrupted operation, the steam blowing line offers the advantage of requiring for condensate removal a relatively slight pressure differential and an appropriately small amount of steam flowing through.

The following discussion of two situations or cases helps point out the advantages provided by the invention. In one case, it can never be ruled out with 100% certainty that the pressure differential which in normal operation is required between the condensate suction pipe and the cylinder interior occasionally will inadvertantly be too low or gradually break down completely. In this case, the danger existed heretofore that the thickness of the condensate ring deposited on the cylinder will continue to increase thereby resulting in a reduction of the heat transfer from the steam to the cylinder shell. The rising condensate level, as previously mentioned, will first hinder the entrance of steam into the interior of the suction mouthpiece at the entrance gap, and finally interrupt it completely. If the condensate level continues to rise and a steam side channel designed as a plain bore is provided in the suction mouthpiece, it may happen that this bore will as well be flooded by the condensate ring and become ineffective as well so that the condensate removal is thereby further reduced or completely interrupted. The danger of this condition happening is removed by the novel design of the rotating siphon due to the fact that the mouth of the steam blowing line is arranged in the area of the suction opening of the suction mouthpiece so as to be a very short distance from the cylinder inside wall. As a result, at the beginning of a reduction of said pressure differential, and thus, at the beginning of the continued accumulation of the condensate ring, an increased feeding effect is exerted on the condensate when the condensate level has risen only up to the mouth of the steam blowing line which is much sooner than with earlier devices. With the originating point of the steam line, i.e., the entrance opening, permitting an arrangement at a distance from the cylinder inside wall much greater than with a plain bore, the danger is now eliminated that the inlet opening of the steam blowing line will be flooded.

In exceptional cases it can be necessary, upon operational interferences, to temporarily shutdown the drying cylinder(s) on the paper machine. Such shutdown is normally for only a short time whereby the steam supply is maintained so that the temperature of the cylinder outside will not decrease. In this case, a condensate sump will form in the drying cylinder. Under these conditions with earlier device, condensate removal can take place only when the drying cylinder happens to come to a standstill in a position where the suction mouthpiece of the condensate suction pipe dips into the condensate sump. As can be appreciated, this seldom happens so that the suction mouthpiece is normally located outside the condensate sump which results in the condensate sump level continuing to rise for the duration of the shutdown. Therefore, a greater amount of condensate must initially be removed as the paper machine is restarted. Because of the novel design of the rotating siphon, as explained above, this condensate removal is readily possible. In contrast, the danger exists with prior devices that the condensate removal will fail after a machine shutdown.

According to a further feature of the invention, the mouth of the steam blowing line is arranged so that the direction of flow of the steam discharging from the mouth is essentially parallel to the direction of flow of condensate as it travels from the suction mouthpiece into the suction pipe. This structure enables a further enhancement of the feeding effect of the discharging steam jet upon the condensate for the steam proceeds here directly into the condensate suction pipe making the device act the same as a steam ejector.

By another feature of the invention, an insert shaped like a wedge, cone or pyramid is positioned inside the suction mouthpiece so that the point of the insert is directed at the axis of rotation of the cylinder and the mouth of the steam blowing line is positioned in the insert. By still another feature of the invention, the point of the influx of the steam blowing line is positioned in the area of the axis of rotation of the cylinder.

The above-mentioned and other features and objects of this invention and the manner of attaining them will become more apparent and the invention itself will be best understood by reference to the following description of an embodiment of the invention taken in conjunction with the accompanying drawings.

DETAILED DESCRIPTION OF SPECIFIC EMBODIMENTS

Figure 1:
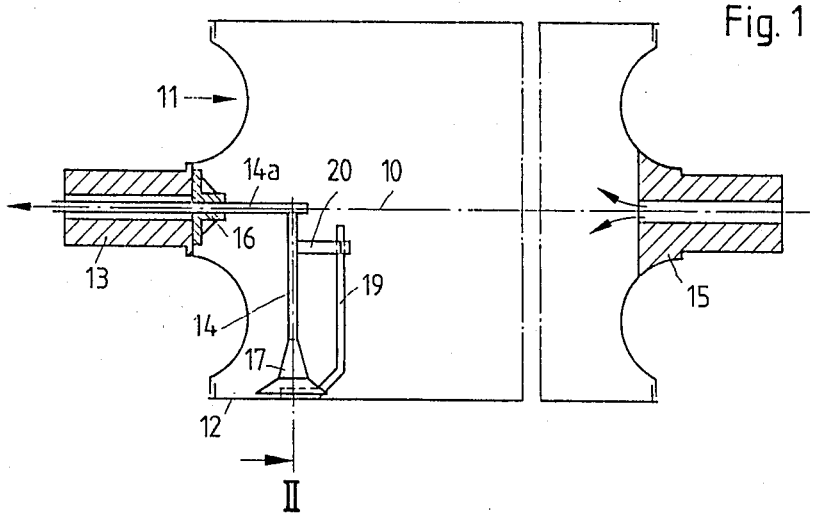
FIG. 1 shows schematically a drying cylinder in longitudinal section.

The drying cylinder is generally designated as 11 and comprises a shell 12, and on each end of the shell there is a cylinder cover with a hollow journal 13, 15. Drying cylinder 11 can be heated with steam which is fed through the journal 15 into the interior of the drying cylinder. The condensate forming in the cylinder is removed with the aid of a condensate suction pipe, having two sections **14, 14*a*, from the cylinder. A section 14 of the condensate suction pipe, which can be either straight or bent, extends approximately radially from the inside wall of the cylinder shell 12 to the axis of rotation 10 of the cylinder. A coaxial section 14*a* of condensate suction pipe is mounted on the journal 13 with the aid of support 16 and extends outwardly through the journal 13. The radial section 14 of the suction pipe is fluidly connected at its radially inward end to the axial section 14*a* of the suction pipe. Thus, it can be seen that the condensate suction pipe, comprised of two sections 14, 14*a*, is rigidly attached in drying cylinder 11** and rotates together with it.

Figure 2:
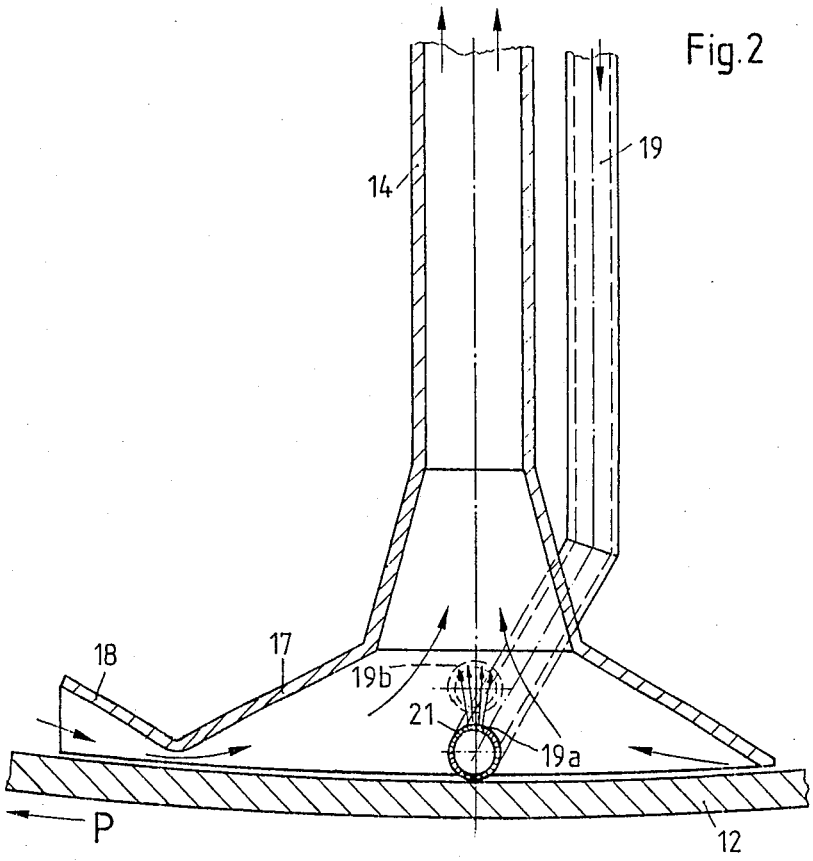
FIG. 2 shows a partial cross section of the drying cylinder along line II of FIG. 1.

At the radially outer end of the condensate suction pipe section 14 i.e., the end near the inside wall of the cylinder shell 12, the condensate suction pipe has a suction mouthpiece 17 having the shape of a bell or lampshade with a suction opening, that can be round or square, facing the inside wall of the cylinder shell 12. In FIG. 2, the direction of rotation of the drying cylinder 11 and the condensate suction pipe is indicated by arrow P. A suction snout 18 may be provided on the suction mouthpiece 17 wherein the snout 18 opens in the direction of rotation. The edges of the suction mouthpiece 17 extend a short distance from the inside surface of the cylinder shell forming a narrow entrance gap between the suction mouthpiece 17 and the cylinder shell 12.

A steam blowing pipe 19 extends from the area of the axis of rotation 10 of the cylinder to the interior of the suction mouthpiece 17. This pipe 19 is open at its radially inner end thereby permitting steam to enter therein. It is attached to the condensate suction pipe by means of a support 20. The end **19*a* of the steam blowing pipe 19 located in the suction mouthpiece 17 can bear directly on the inside of the cylinder shell 12 (as illustrated in FIG. 2 by solid lines) or the end can be arranged at a certain distance from the cylinder shell 12 (as indicated at 19*b* by broken lines). According to FIG. 1, the spacing of the inflow end of the pipe 19 from the axis of rotation 10 is rather small. However, it should be appreciated that this spacing may be selected to be greater than that illustrated so that pipe 19 will be shorter than shown in FIG. 1**.

The end **19*a* (or 19*b*) of the steam blowing line 19 contained in the suction mouthpiece 17 is sealed at its end. At least one discharge opening 21 for the steam is arranged in the wall of the steam blowing pipe 19, and the opening 21 faces the condensate suction pipe 14. In operation, the influx of the steam/condensate mixture enters the mouthpiece 17 through the entrance gap and/or through the suction snout 18 and passes into the interior of the suction mouthpiece 17. The steam/condensate mixture then passes from there into the condensate suction pipe 14 as indicated in FIG. 2 by arrows. Referring again to FIG. 2, it can be seen that the steam discharging or exiting from the steam blowing pipe 19 moves in a direction indicated by arrows, and this direction of travel of the steam from pipe 19** is generally parallel to the direction of travel of the steam/condensate mixture.

As a variation from the specific embodiment of FIG. 2, if so required, a nozzle may be installed in the discharge opening 21. It is also possible to arrange an insert inside the suction mouthpiece, where the insert is shaped like a wedge, a cone or a pyramid and whose point is directed toward the condensate suction pipe 14. In this case, the steam blowing pipe 19 may extend into the insert and the insert may then provide for one or several steam discharge openings.

Figure 3:
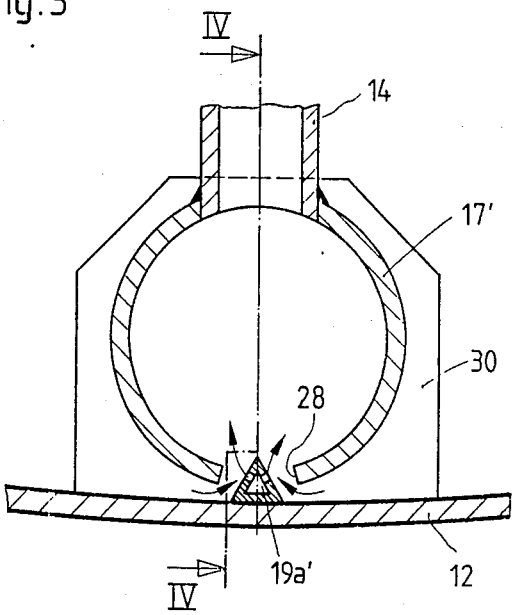
FIG. 3 shows a partial cross section corresponding to FIG. 2 and featuring a siphon design different from that of FIGS. 1 and 2.
Figure 4:
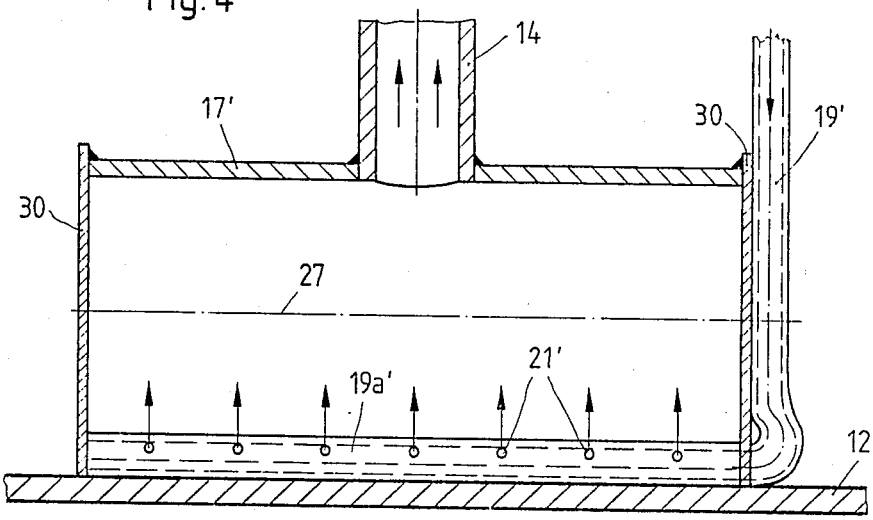
FIG. 4 shows a longitudinal section along line IV—IV of FIG. 3.

A specific embodiment utilizing an insert is presented in FIGS. 3 and 4. The suction mouthpiece 17' is shaped there as a pipe section whose axis 27 extends parallel with the axis of rotation 10 of the cylinder. The pipe section 17' is on both of its ends sealed by a cover plate 30. The two cover plates 30 likewise form support ribs with which the suction mouthpiece 17' bears on the inside surface of the cylinder shell 12. The pipe section 17' has near the cylinder shell 12 an elongate slot 28 forming the suction opening of the suction mouthpiece 17'. In a fashion similar to that previously described, the suction mouthpiece 17' connects to a condensate suction pipe 14.

This design of the suction mouthpiece 17' has a number of advantages set forth below. The manufacture of suction mouthpiece 17' is especially simple and cost-saving. Since the suction mouthpiece bears with its support ribs 30 on the cylinder shell 12, the suction opening 28 can be positioned precisely relative to the inside surface of the cylinder shell 12 thereby making it possible to accurately maintain the space which is required between the inside surface of the cylinder shell 12 and the suction mouthpiece 17'. If need be, this space could be varied by making the support ribs 30 adjustable. Further, the cylinder-shaped outside of the pipe section 17' has the effect of a suction snout similar to the suction snout 18 illustrated in FIG. 2. In order to achieve this purpose it is not absolutely necessary for the pipe section 17' to have a circular cross section since a polygonal cross section is also suitable. Notwithstanding the particular cross section of pipe section 17' the installation of an additional suction snout 18, such as in FIG. 2, is not necessary for the specific embodiment of FIGS. 3 and 4.

In a fashion similar to that illustrated in FIGS. 1 and 2, a steam blow line 19' is provided wherein its end 19a' is located in the suction mouthpiece 17' and extends along the elongate slot 28 of pipe section 17'. In the illustrated specific embodiment of FIGS. 3 and 4, said end 19a of the steam blow line 19' is formed by a pipe having a triangular cross section. Steam blow line 19' bears with one side face on the inside surface of the cylinder shell 12 so that the opposite edge protrudes into elongate slot 28. Several steam discharge openings 21' are provided near this edge. This arrangement of the steam blow line 19', 19a' in the suction opening 28 of the suction mouthpiece 17' results in portion 19a' of the steam blow line 19' acting like an insert so as to deflect the condensate flowing down the cylinder wall 12 into the interior of the suction mouthpiece 17'. It should be appreciated that the same effect can be achieved if portion 19a' of the steam blow line has a circular cross section as long as it bears on the inside surface of the cylinder shell 12.

In case the condensate forms a sump in the drying cylinder, the tubular shape of the suction mouthpiece 17' promotes the condensate removal since if the suction mouthpiece 17' extends through the sump it will at least partly fill up with condensate. This condensate empties into the suction pipe 14 by the scoop effect of the suction mouthpiece 17' when the suction mouthpiece 17', due to the cylinder rotation, has advanced to the top.

While there have been described above the principles of this invention in connection with specific apparatus, it is to be clearly understood that this description is made only by way of example and not as a limitation of the scope of the invention.

What is claimed is:

1. A device in a paper machine for removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening, which suction mouthpiece is formed as a pipe section sealed at its ends, said piper section having an essentially circular cross-section and an axis extending generally parallel with the axis of rotation of the drying cylinder, the suction opening including an elongate slot positioned near and together with the inside surface of the cylinder shell defines an inlet gap;

a side channel means externally mounted on and generally parallel to said suction pipe, provided on the suction mouthpiece, for additionally feeding steam to the interior of the suction mouthpiece; and said side channel means including a steam blowing line extending from the interior of the drying cylinder into the interior of the suction mouthpiece, and said steam blowing line having a mouth arranged in the area of the suction opening so that the direction of flow of the steam discharging from the mouth is generally parallel to the direction of flow of the condensate as it flows from the suction mouthpiece towards the suction pipe, which steam blowing line has a point of influx arranged in the area of the drying cylinder axis of rotation.

2. The device according to claim 1 wherein the end of the steam blow line contained in the suction mouthpiece is centrally positioned within and extends along the elongate slot.

3. The device according to claim 1 wherein the suction mouthpiece includes support ribs on its exterior surface with which it bears on the inside surface of the cylinder shell.

4. The device according to claim 3 wherein the support ribs further seal the ends of the suction mouthpiece.

5. A device for the removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening and together with the inside surface of the cylinder shell defines an inlet gap;

a side channel means, provided on the suction mouthpiece, for additionally feeding stream to the interior of the suction mouthpiece;

said side channel means including a steam blowing line extending from the interior of the drying cylinder into the interior of the suction mouthpiece, and said steam blowing line having a mouth arranged in the area of the suction opening, said mouth of the steam blowing line positioned so that the direction of flow of the steam discharging from the mouth is generally parallel to the direction of flow of the condensate as it flows from the suction mouthpiece towards the suction pipe; and a wedge-shaped insert positioned inside the suction mouthpiece, said insert having an edge directed at the axis of rotation of the cylinder, the mouth of the steam blowing line positioned in the insert.

6. The device as claimed in claim 5 wherein said suction mouthpiece is a pipe section sealed at its ends, which pipe section has an essentially circular cross section.

7. A device in a paper machine for the removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening and together with the inside surface of the cylinder shell defines an inlet gap;

a side channel means, provided on the suction mouthpiece, for additionally feeding steam to the interior of the suction mouthpiece;

said side channel means including a steam blowing line extending from the interior of the drying cylinder into the interior of the suction mouthpiece, and said steam blowing line having a mouth arranged in the area of the suction opening, said mouth of the steam blowing line positioned so that the direction of flow of the steam discharging from the mouth is generally parallel to the direction of flow of the condensate as it flows from the suction mouthpiece towards the suction pipe; and a cone-shaped insert positioned inside the suction mouthpiece, said insert having a point directed at the axis of rotation of the cylinder, the mouth of the steam blowing line positioned in the insert.

8. A device in a paper machine for the removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening and together with the inside surface of the cylinder shell defines an inlet gap;

a side channel means, provided on the suction mouthpiece, for additionally feeding steam to the interior of the suction mouthpiece;

said side channel means including a steam blowing line extending from the interior of the drying cylinder into the interior of the suction mouthpiece, and said steam blowing line having a mouth arranged in the area of the suction opening, said mouth of the steam blowing line positioned so that the direction of flow of the steam discharging from the mouth is generally parallel to the direction of flow of the condensate as it flows from the suction mouthpiece towards the suction pipe; and a pyramid-shaped insert positioned inside the suction mouthpiece, said insert having a point directed at the axis of rotation of the cylinder, the mouth of the steam blowing line positioned in the insert.

9. A device in a paper machine for the removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening and together with the inside surface of the cylinder shell defines an inlet gap, said suction mouthpiece formed as a pipe section sealed at its ends, said pipe section having an essentially circular cross section and having an axis extending generally parallel with the axis of rotation of the drying cylinder, the suction opening comprising an elongate slot positioned near the inside surface of the cylinder shell;

a side channel means provided on the suction mouthpiece, for additionally feeding steam to the interior of the suction mouthpiece;

said side channel means including a steam blowing line extending from the interior of the drying cylinder into the interior of the suction mouthpiece, said steam blowing line having a mouth arranged in the area of the suction opening centrally positioned within and extending along the elongate slot, and wherein the end of the steam blow line extending along the elongate slot contained within the suction mouthpiece contacts and bears on the inside surface of the cylinder shell.

10. A device in a paper machine for the removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the outer end of said condensate suction pipe, said suction mouthpiece having a suction opening and together with the inside surface of the cylinder shell defines an inlet gap, said suction mouthpiece formed as a pipe section sealed at its ends, said pipe section having an essentially circular cross section and having an axis extending generally parallel with the axis of rotation of the drying cylinder, the suction opening comprising an elongate slot positioned near the inside surface of the cylinder shell;

a side channel means provided on the suction mouthpiece, for additionally feeding steam to the interior of the suction mouthpiece;

said side channel means including a steam blowing line extending from the interior of the drying cylinder into the interior of the suction mouthpiece, said steam blowing line having a mouth arranged in the area of the suction opening centrally positioned with and extending along the elongate slot, and wherein the end of the steam blow line contained within the suction mouthpiece has an essentially triangular cross section, one side of said end of said steam blow line faces the inside surface of the cylinder shell so that the opposite edge of the end protrudes into the elongate slot.

11. A device in a paper machine for removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the radially outer end of said condensate suction pipe, said suction mouthpiece having a suction opening, which suction mouthpiece is formed as a pipe section sealed at its ends, said pipe section having an essentially circular cross-section and an axis extending generally parallel with the axis of rotation of the drying cylinder, the suction opening including an elongate slot positioned near and cooperating with said inside surface of the cylinder shell, to define two inlet gaps;

an insert bearing on said inside surface of said cylinder shell, which insert is positioned within and extends along said elongate slot.

12. A device in a paper machine for removal of condensate from a steam-heated, rotatable drying cylinder having a cylinder shell defining an inside surface comprising:

a condensate suction pipe having inner and outer ends, said suction pipe rotating together with the drying cylinder and extending from the area of the axis of rotation of the drying cylinder to the inside surface of the cylinder shell;

a suction mouthpiece at the radially outer end of said condensate suction pipe, said suction mouthpiece having a suction opening, which suction mouthpiece is formed as a pipe section sealed at its ends, said pipe section having a shell defining a substantially cylindrical volume with a diameter and having an essentially polygonal cross-section and an axis extending generally parallel with the axis of rotation of the drying cylinder, the suction opening including an elongate slot, which slot has a width that is narrow in relation to said cylindrical diameter and positioned near and cooperating with said inside surface of the cylinder shell, to define two opposed inlet gaps;

an insert bearing on said inside surface of said cylinder shell, which insert is positioned within and extends along said elongate slot.

* * * * *

UNITED STATES PATENT AND TRADEMARK OFFICE

CERTIFICATE OF CORRECTION

PATENT NO. : 4,718,177

DATED : January 12, 1988

INVENTOR(S) : Winfried Haeszner et al

It is certified that error appears in the above-identified patent and that said Letters Patent is hereby corrected as shown below:

Claim 5, Col. 6, line 61, after "device" add --in a paper machine--.

Signed and Sealed this

Twelfth Day of July, 1988

*Attest:*

*Attesting Officer*

DONALD J. QUIGG

*Commissioner of Patents and Trademarks*